US008400442B2

(12) United States Patent
Yamashita et al.

(10) Patent No.: US 8,400,442 B2
(45) Date of Patent: Mar. 19, 2013

(54) DISPLAY, METHOD FOR DRIVING DISPLAY, ELECTRONIC APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1325 days.

(21) Appl. No.: 12/078,892

(22) Filed: Apr. 8, 2008

(65) Prior Publication Data

US 2008/0284774 A1 Nov. 20, 2008

(30) Foreign Application Priority Data

May 16, 2007 (JP) ..... 2007-131006

(51) Int. Cl.
*G09G 5/00* (2006.01)

(52) U.S. Cl. ..... 345/212; 345/205; 345/76

(58) Field of Classification Search ..... 345/212, 345/205, 76

See application file for complete search history.

(56) References Cited

U.S. PATENT DOCUMENTS

| | | | | |
|---|---|---|---|---|
| 7,800,565 | B2 | 9/2010 | Nathan et al. | |
| 7,847,796 | B2 * | 12/2010 | Shin et al. | 345/210 |
| 2010/0201661 | A1 * | 8/2010 | Kimura et al. | 345/205 |
| 2010/0277402 | A1 * | 11/2010 | Miyazawa | 345/76 |

FOREIGN PATENT DOCUMENTS

| | | | |
|---|---|---|---|
| JP | 2001-203078 | A | 7/2001 |
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2004-295131 | A | 10/2004 |
| JP | 2006-106076 | A | 4/2006 |
| JP | 2008-523425 | A | 7/2008 |
| WO | WO-2005/114629 | A1 | 12/2005 |
| WO | WO-2006/060902 | A1 | 6/2006 |

OTHER PUBLICATIONS

English Language translation of Japanese Office Action issued Dec. 13, 2011 for corresponding Japanese Application No. 2007-131006.

Japanese Office Action issued Nov. 13, 2012 for corresponding Japanese Application No. 2007-131006.

* cited by examiner

*Primary Examiner* — William Boddie
*Assistant Examiner* — Leonid Shapiro
(74) *Attorney, Agent, or Firm* — Rader, Fishman & Grauer PLLC

(57) ABSTRACT

A display includes: a pixel array section configured to include power feed lines, scan lines disposed along rows, signal lines disposed along columns, and pixels that are disposed at intersections of the scan lines and the signal lines and are arranged in a matrix, each of the pixels including a drive transistor and a light-emitting device, one of a pair of current terminals as source and drain of the drive transistor being connected to the power feed line, and a power supply scanner configured to sequentially switch potential of each power feed line between higher potential and lower potential, wherein the power supply scanner switches the higher potential applied to the power feed line between first higher potential and second higher potential at different levels in a predetermined sequence.

4 Claims, 14 Drawing Sheets

DISPLAY, METHOD FOR DRIVING DISPLAY, ELECTRONIC APPARATUS

CROSS REFERENCES TO RELATED APPLICATIONS

The present invention contains subject matter related to Japanese Patent Application JP 2007-131006 filed in the Japan Patent Office on May 16, 2007, the entire contents of which being incorporated herein by reference.

BACKGROUND OF THE INVENTION

1. Field of the Invention

The present invention relates to a display in which light-emitting devices provided on a pixel-by-pixel basis are driven by current for image displaying, and a method for driving the display. Furthermore, the present invention relates to electronic apparatus including the display. Specifically, the present invention relates to a drive system for a so-called active-matrix display in which the amount of current applied to a light-emitting device, such as an organic EL device, is controlled by insulated-gate field effect transistors provided in each pixel circuit.

2. Description of the Related Art

In recent years, development of flat self-luminous displays employing organic EL devices as light-emitting devices is being actively promoted. The organic EL device employs a phenomenon that an organic thin film emits light in response to application of an electric field thereto. The organic EL device can be driven by application voltage of 10 V or lower, and thus has low power consumption. Furthermore, because the organic EL device is a self-luminous element that emits light by itself, it does not need an illuminating unit and thus can easily achieve reduction in the weight and thickness of a display. Moreover, the response speed of the organic EL device is as very high as about several microseconds, which causes no image lag in displaying of a moving image.

Among the flat self-luminous displays employing the organic EL devices for the pixels, particularly an active-matrix display in which thin film transistors are integrally formed as drive elements in the respective pixels is being actively developed. Active-matrix flat self-luminous displays are disclosed in e.g. Japanese Patent Laid-open No. 2003-255856, 2003-271095, 2004-133240, 2004-029791, and 2004-093682.

SUMMARY OF THE INVENTION

However, in the active-matrix flat self-luminous displays of the related arts, the threshold voltage and mobility of the transistor for driving the light-emitting device (i.e. a drive transistor) vary due to process variation. Furthermore, the current-voltage characteristic of the organic EL device also changes over time. The variation in the characteristics of the drive transistor and the change in the characteristic of the organic EL device will affect the light-emission luminance. In order to uniformly control the light-emission luminance across the entire screen of the display, the variation in the characteristics of the drive transistor and the organic EL device needs to be corrected in the respective pixel circuits. A display in which each pixel is provided with this correction function has been proposed as a related art.

In order to stably carry out an operation of correcting the threshold voltage and mobility of the drive transistor, it is preferable for a capacitive element formed in each pixel to have a capacitance that is as high capacitance as possible. The capacitive element is formed of a thin film element similarly to the drive transistor, and the dielectric film of the capacitive element is formed of the same layer as that of the gate insulating film of the drive transistor. For increasing the capacitance of the capacitive element, the thickness of the dielectric film needs to be decreased, which inevitably decreases the thickness of the gate insulating film. This tends to decrease the insulation breakdown voltage between the drain and source of the drive transistor.

Meanwhile, in order to carry out the mobility correction operation and the threshold voltage correction operation in the respective pixel circuits, the supply voltage to the respective pixels needs to be switched between high level and low level in a predetermined sequence. This is because a large potential difference possibly arises between the source and drain of the drive transistor in the process of the switching of the supply voltage level and this potential difference would surpass the insulation breakdown voltage of the drive transistor depending on the case. In terms of this point, the insulation breakdown voltage of the drive transistor in related arts needs to be high to some extent, which precludes enhancement in the capacitance of the capacitive element.

According to an embodiment of the present invention, there is provided a display including:

a pixel array section configured to include power feed lines, scan lines disposed along rows, signal lines disposed along columns, and pixels that are disposed at intersections of the scan lines and the signal lines and are arranged in a matrix, each of the pixels including a drive transistor and a light-emitting device, one of a pair of current terminals as source and drain of the drive transistor being connected to the power feed line; and a power supply scanner configured to sequentially switch a potential of each power feed line between a higher potential and a lower potential, wherein the power supply scanner switches the higher potential applied to the power feed line between a first higher potential and a second higher potential at different levels in a predetermined sequence.

According to another embodiment of the present invention, there is provided a method for driving a display including a pixel array section and a power supply scanner, the pixel array section including power feed lines, scan lines disposed along rows, signal lines disposed along columns, and pixels that are disposed at intersections of the scan lines and the signal lines and are arranged in a matrix, each of the pixels including a drive transistor and a light-emitting device, one of a pair of current terminals as source and drain of the drive transistor being connected to the power feed line, the power supply scanner sequentially switching potential of each power feed line between a higher potential and a lower potential, the method including the step of switching the higher potential applied to the power feed line between a first higher potential and a second higher potential at different levels in a predetermined sequence by using the power supply scanner, to thereby prevent voltage applied between the source and drain of the drive transistor from surpassing insulation breakdown voltage in a series of operations of the pixel.

According to yet another embodiment of the present invention, there is provided an electronic apparatus having a display including:

a pixel array section configured to include power feed lines, scan lines disposed along rows, signal lines disposed along columns, and pixels that are disposed at intersections of the scan lines and the signal lines and are arranged in a matrix, each of the pixels including a drive transistor and a light-emitting device, one of a pair of current terminals as source and drain of the drive transistor being connected to the power feed line; and a power supply scanner configured to sequentially switch potential of each power feed line between a higher potential and a lower potential, wherein the power supply scanner switches the higher potential applied to the power feed line between a first higher potential and a second higher potential at different levels in a predetermined sequence.

According to the embodiment of the present invention, the higher potential applied to the power feed line is switched between the first higher potential and the second higher potential at different levels in a predetermined sequence. This prevents excess voltage from being applied between the source and drain of the drive transistor in the series of operation of the pixel. Thus, the insulation breakdown voltage between the source and drain of the drive transistor can be lowered compared with related arts. In other words, the thickness of the gate insulating film of the drive transistor can be decreased. Therefore, along with this thickness decrease, the thickness of the dielectric film of a holding capacitor is also decreased, which allows enhancement in the capacitance of the holding capacitor.

DETAILED DESCRIPTION OF THE PREFERRED EMBODIMENTS

Figure 1:
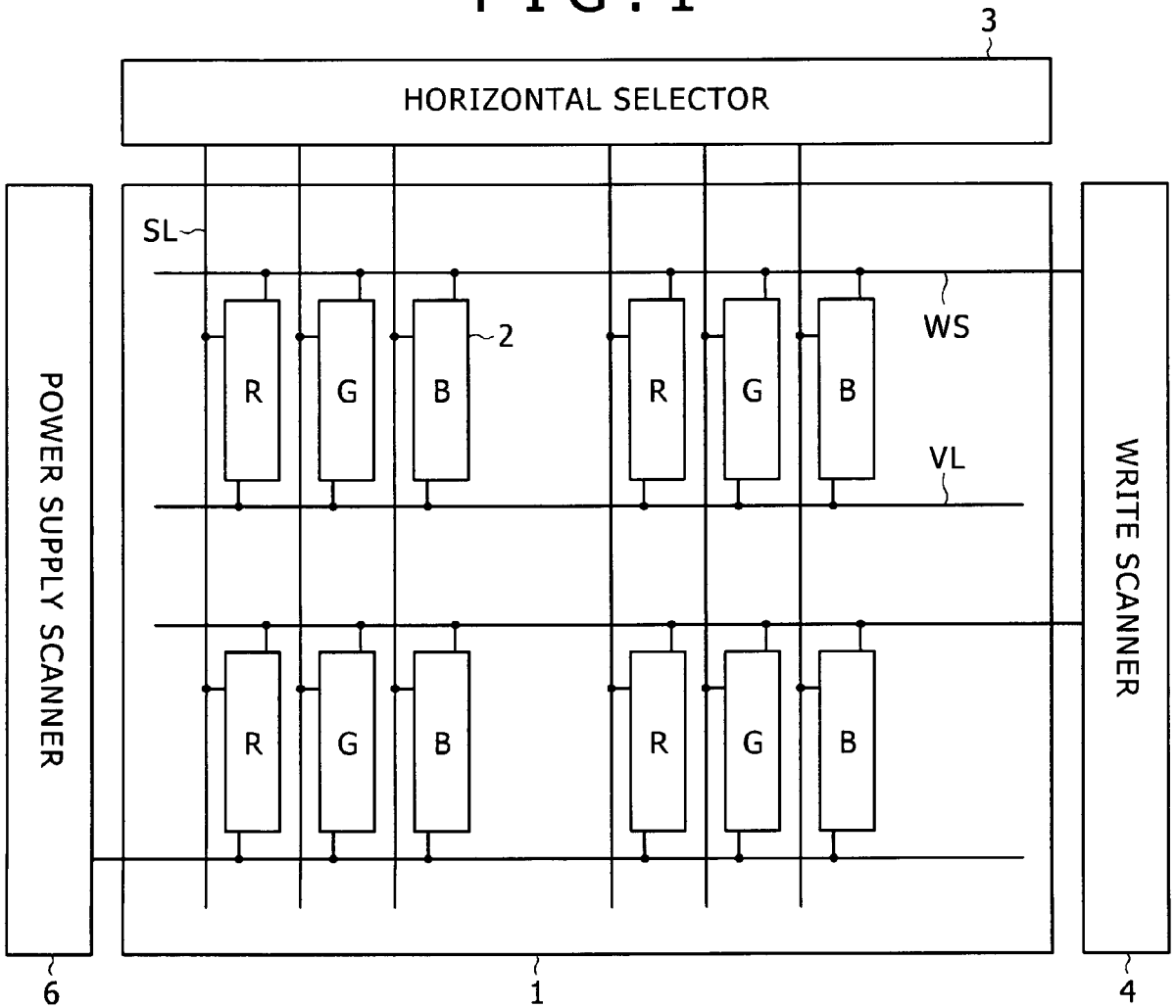
FIG. 1 is a block diagram showing the entire configuration of a display according to an embodiment of the present invention.

An embodiment of the present invention will be described in detail below with reference to the accompanying drawings. FIG. 1 is a block diagram showing the entire configuration of a display according to the embodiment. As shown in FIG. 1, this display includes a pixel array section 1 and a drive section for driving the pixel array section 1. The pixel array section 1 includes scan lines WS disposed along the rows, signal lines SL disposed along the columns, pixels 2 disposed at the intersections of both the lines so as to be arranged in a matrix, and power feed lines (power supply lines) VL disposed corresponding to the respective rows of the pixels 2. In the present example, any of the three primary colors of R, G, and B is allocated to each of the pixels 2, and thus color displaying is possible. However, the embodiment is not limited thereto but encompasses devices of single-color displaying. The drive section includes a write scanner 4, a power supply scanner 6, and a signal selector (horizontal selector) 3. The write scanner 4 sequentially supplies a control signal to the respective scan lines WS to thereby line-sequentially scan the pixels 2 on a row-by-row basis. The power supply scanner 6 provides a supply voltage that is to be switched between a first potential and a second potential to the respective power feed lines VL in matching with the line-sequential scanning. The signal selector 3 supplies a signal potential as a drive signal and a reference potential to the column signal lines SL in matching with the line-sequential scanning.

Figure 2:
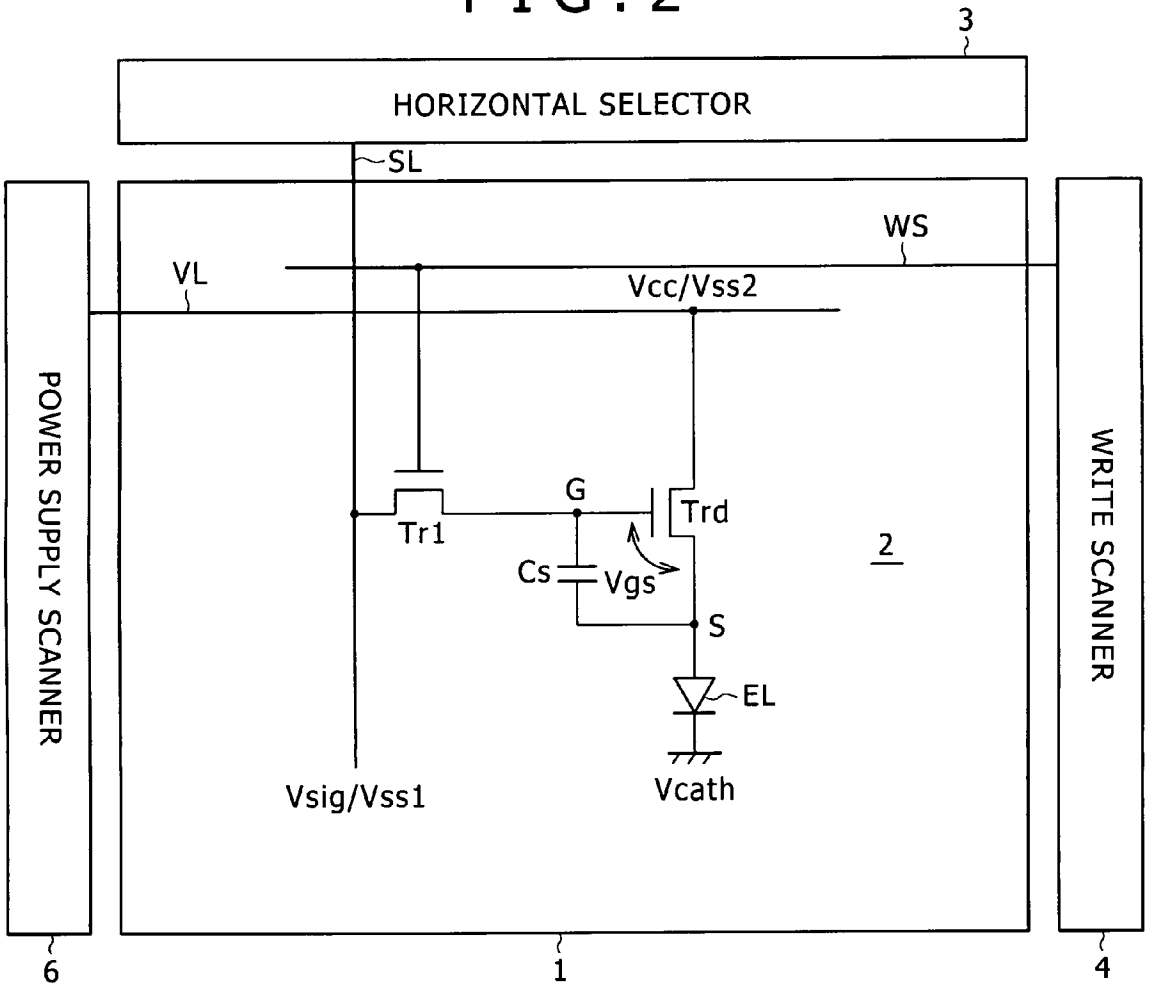
FIG. 2 is a circuit diagram showing one example of a pixel included in the display shown in FIG. 1.

FIG. 2 is a circuit diagram showing the specific configuration and connection relationship of the pixel 2 included in the display shown in FIG. 1. As shown in FIG. 2, the pixel 2 includes a light-emitting device EL typified by an organic EL device, a sampling transistor Tr1, a drive transistor Trd, and a holding capacitor Cs. The control terminal (gate) of the sampling transistor Tr1 is connected to the corresponding scan line WS. One of a pair of current terminals (source and drain) of the sampling transistor Tr1 is connected to the corresponding signal line SL, and the other is connected to the control terminal (gate G) of the drive transistor Trd. One of a pair of current terminals (source S and drain) of the drive transistor Trd is connected to the light-emitting device EL, and the other is connected to the corresponding power feed line VL. In the present example, the drive transistor Trd is an N-channel transistor. The drain thereof is connected to the power feed line VL, and the source S thereof is connected as the output node to the anode of the light-emitting device EL. The cathode of the light-emitting device EL is connected to a predetermined cathode potential Vcath. The holding capacitor Cs is connected between the source S and the gate G, which are one of the current terminals and control terminal, respectively, of the drive transistor Trd.

In this configuration, the sampling transistor Tr1 is turned on in response to the control signal supplied from the scan line WS, to thereby sample the signal potential supplied from the signal line SL and hold the sampled potential in the holding capacitor Cs. The drive transistor Trd receives current supply from the power feed line VL at the first potential (higher potential Vcc) and applies a drive current to the light-emitting device EL depending on the signal potential held in the holding capacitor Cs. The write scanner 4 outputs the control signal having a predetermined pulse width to the scan line WS so that the sampling transistor Tr1 may be kept at the conductive state in the time zone during which the signal line SL is at the signal potential. Thereby, the signal potential is held in the holding capacitor Cs, and simultaneously with this, correction against the mobility μ of the drive transistor Trd is added to the signal potential. Thereafter, the drive transistor Trd supplies the light-emitting device EL with the drive current dependent upon the signal potential Vsig written to the holding capacitor Cs, which starts light-emission operation.

This pixel circuit 2 has a threshold voltage correction function in addition to the above-described mobility correction function. Specifically, the power supply scanner 6 switches the potential of the power feed line VL from the first potential (higher potential Vcc) to the second potential (lower potential Vss2) at a first timing before the sampling of the signal potential Vsig by the sampling transistor Tr1. Furthermore, the write scanner 4 turns on the sampling transistor Tr1 at a second timing before the sampling of the signal potential Vsig by the sampling transistor Tr1, to thereby apply the reference potential Vss1 from the signal line SL to the gate G of the drive transistor Trd and set the source S of the drive transistor Trd to the second potential (Vss2). The power supply scanner 6 switches the potential of the power feed line VL from the second potential Vss2 to the first potential Vcc at a third timing after the second timing, to thereby hold the voltage equivalent to the threshold voltage Vth of the drive transistor Trd in the holding capacitor Cs. This threshold voltage correction function allows the display to cancel the influence of variation in the threshold voltage Vth of the drive transistor Trd from pixel to pixel.

The pixel circuit 2 further has a bootstrap function. Specifically, at the timing when the signal potential Vsig is held in the holding capacitor Cs, the write scanner 4 stops the application of the control signal to the scan line WS to thereby turn the sampling transistor Tr1 to the non-conductive state and thus electrically isolate the gate G of the drive transistor Trd from the signal line SL. Due to this operation, the potential of the gate G changes in linkage with change in the potential of the source S of the drive transistor Trd, which allows the voltage Vgs between the gate G and the source S to be kept constant.

A feature of the present embodiment is that the power supply scanner 6 switches the higher potential Vcc applied to the power feed line VL between first higher potential and second higher potential at different levels in a predetermined sequence so that the voltage applied between the source S and drain D of the drive transistor Trd in the series of operation of the pixel 2 may be prevented from surpassing the insulation breakdown voltage. In the embodiment shown in FIG. 2, the first higher potential is Vcc, and the second higher potential is at a level lower than Vcc. In the present specification, this second higher potential is represented as Vcc2. In the specific operation, the power supply scanner 6 keeps the power feed line VL at the first higher potential Vcc during the light-emission operation of the pixel 2, and keeps it at the second higher potential Vcc2 lower than the first higher potential Vcc during the threshold voltage correction operation of the pixel 2. The levels of the first higher potential Vcc, the second higher potential Vcc2, and the lower potential Vss2 are so designed by the power supply scanner 6 that the voltage applied between the source S and drain D of the drive transistor Trd falls within the saturation operation region in all the operation of the pixel 2 including the threshold voltage correction operation, the mobility correction operation, the signal potential writing operation, and the light-emission operation.

Figure 3:
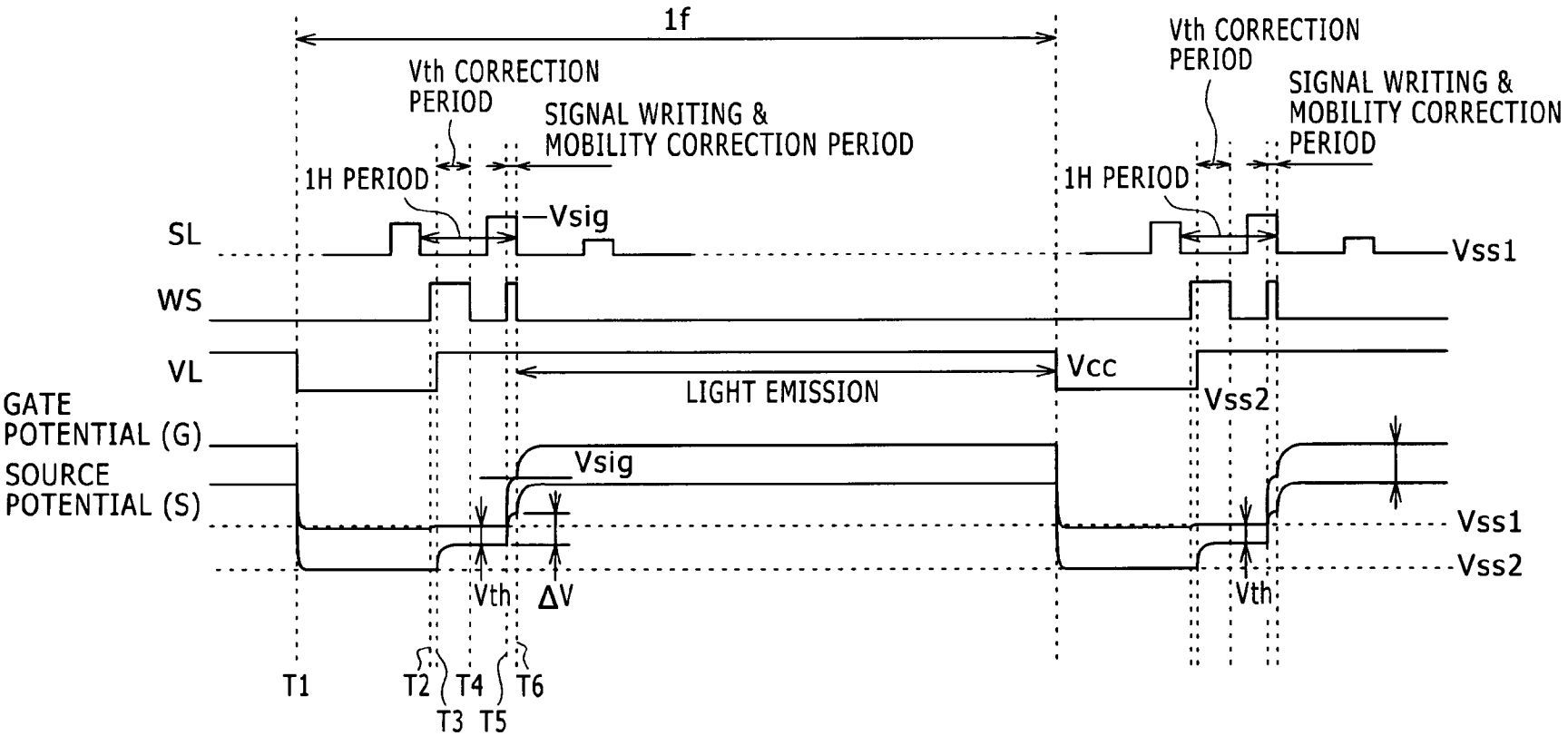
FIG. 3 is a reference timing chart for explaining the operation of the display shown in FIGS. 1 and 2.

FIG. 3 is a timing chart for explaining the operation of the pixel circuit 2 shown in FIG. 2. Note that this timing chart is a reference example in which the potential supplied from the power supply scanner 6 to the power feed line VL is sequentially set to not three levels but two levels: the higher potential Vcc and the lower potential Vss2. In this timing chart, changes in the potential of the scan line WS, the potential of the power feed line VL, and the potential of the signal line SL are shown along the same time axis. Furthermore, in parallel to these potential changes, changes in the potentials of the gate G and source S of the drive transistor Trd are also shown. As shown in the timing chart of FIG. 3, the operation sequence of the pixel proceeds from the light-emission period of the previous field to the non-light-emission period of the description-subject field, and then enters the light-emission period of the description-subject field. In this non-light-emission period, preparation operation, threshold voltage correction operation, signal writing operation, and mobility correction operation are carried out.

In the light-emission period of the previous field, the power feed line VL is at the higher potential Vcc, and the drive transistor Trd supplies a drive current Ids to the light-emitting device EL. The drive current Ids flows from the power feed line VL at the higher potential Vcc via the drive transistor Trd and passes through the light-emitting device EL toward the cathode line.

Subsequently, upon the start of the non-light-emission period of the description-subject field, the potential of the power feed line VL is initially switched from the higher potential Vcc to the lower potential Vss2 at a timing T1. Due to this operation, the power feed line VL is discharged to Vss2, so that the potential of the source S of the drive transistor Trd drops down to Vss2. Thus, the anode potential (i.e., the source potential of the drive transistor Trd) of the light-emitting device EL enters the reverse-bias state, so that the flow of the drive current and hence the light emission are stopped. The potential of the gate G also drops down in linkage with the potential drop of the source S of the drive transistor.

Subsequently, at a timing T2, the potential of the scan line WS is switched from the low level to the high level, so that the sampling transistor Tr1 enters the conductive state. At this time, the signal line SL is at the reference potential Vss1. Therefore, the potential of the gate G of the drive transistor Trd becomes the reference potential Vss1 of the signal line SL via the conductive sampling transistor Tr1. At this time, the potential of the source S of the drive transistor Trd is at the potential Vss2, which is sufficiently lower than Vss1. In this way, initialization is so carried out that the voltage Vgs between the gate G and source S of the drive transistor Trd becomes higher than the threshold voltage Vth of the drive transistor Trd. The period T1-T3 from the timing T1 to a timing T3 is the preparation period in which the voltage Vgs between the gate G and source S of the drive transistor Trd is set higher than Vth in advance.

At the timing T3, the potential of the power feed line VL is switched from the lower potential Vss2 to the higher potential Vcc, so that the potential of the source S of the drive transistor Trd starts rise-up. When the voltage Vgs between the gate G and source S of the drive transistor Trd has reached the threshold voltage Vth in due coarse, the current is cut off. In this way, the voltage equivalent to the threshold voltage Vth of the drive transistor Trd is written to the holding capacitor Cs. This corresponds to the threshold voltage correction operation. In order that the current does not flow to the light-emitting device EL but flows exclusively toward the holding capacitor Cs during the threshold voltage correction operation, the cathode potential Vcath is so designed that the light-emitting device EL is cut off during the threshold voltage correction operation.

At a timing T4, the potential of the scan line WS returns to the low level from the high level. In other words, the application of the first pulse to the scan line WS is stopped, so that the sampling transistor enters the off-state. As is apparent from the above description, the first pulse is applied to the gate of the sampling transistor Tr1 in order to carry out the threshold voltage correction operation.

Thereafter, the potential of the signal line SL is switched from the reference potential Vss1 to the signal potential Vsig. Subsequently, at a timing T5, the potential of the scan line WS rises to the high level from the low level again. In other words, a second pulse is applied to the gate of the sampling transistor Tr1. Due to this pulse application, the sampling transistor Tr1 is turned on again so as to sample the signal potential Vsig from the signal line SL. Thus, the potential of the gate G of the drive transistor Trd becomes the signal potential Vsig. Because the light-emitting device EL is initially at the cut-off state (high-impedance state), the current that runs between the drain and source of the drive transistor Trd flows exclusively toward the holding capacitor Cs and the equivalent capacitor of the light-emitting device EL so as to start charging of these capacitors. Until a timing T6, at which the sampling transistor Tr1 is turned off, the potential of the source S of the drive transistor Trd rises up by ΔV. In this way, the signal potential Vsig of the video signal is written to the holding capacitor Cs in such a manner as to be added to Vth, and the voltage ΔV for the mobility correction is subtracted from the voltage held in the holding capacitor Cs. Therefore, the period T5-T6 from the timing T5 to the timing T6 serves as the signal writing period & mobility correction period. In other words, in response to the application of the second pulse to the scan line WS, the signal writing operation and the mobility correction operation are carried out. The length of the signal writing period & mobility correction period T5-T6 is equal to the pulse width of the second pulse. That is, the pulse width of the second pulse defines the mobility correction period.

In this manner, the writing of the signal potential Vsig and the adjustment by the correction amount ΔV are simultaneously carried out in the signal writing period T5-T6. The higher Vsig is, the larger the current Ids supplied by the drive transistor Trd and hence the absolute value of ΔV are. Consequently, the mobility correction dependent upon the light-emission luminance level is carried out. When Vsig is constant, higher mobility μ of the drive transistor Trd provides a larger absolute value of ΔV. In other words, higher mobility μ provides a larger amount ΔV of the negative feedback to the holding capacitor Cs. Therefore, variation in the mobility μ from pixel to pixel can be eliminated.

At the timing T6, the potential of the scan line WS is switched to the low level as described above, so that the sampling transistor Tr1 enters the off-state. This isolates the gate G of the drive transistor Trd from the signal line SL. Simultaneously, the flowing of the drain current Ids through the light-emitting device EL starts. This causes the anode potential of the light-emitting device EL to rise up depending on the drive current Ids. The rise-up of the anode potential of the light-emitting device EL is equivalent to the rise-up of the potential of the source S of the drive transistor Trd. If the potential of the source S of the drive transistor Trd rises up, the potential of the gate G of the drive transistor Trd also rises up in linkage with the rise-up of the potential of the source S due to the bootstrap operation of the holding capacitor Cs. The rise amount of the gate potential is equal to that of the source potential. Therefore, in the light-emission period, the voltage Vgs between the gate G and source S of the drive transistor Trd is kept constant. This voltage Vgs arises from the addition of the correction of the threshold voltage Vth and the mobility μ to the signal potential Vsig. The drive transistor Trd operates in its saturation region. That is, the drive transistor Trd supplies the drive current Ids dependent upon the voltage Vgs between the gate G and the source S. This voltage Vgs arises from the addition of the correction of the threshold voltage Vth and the mobility μ to the signal potential Vsig.

In the reference example shown in FIG. 3, the write scanner 4 outputs a pulse of the control signal twice in 1 H. The pixel 2 carries out the threshold voltage correction in response to the first pulse, and carries out the signal potential writing operation and the mobility correction operation simultaneously in response to the second pulse. As the levels of the supply voltage provided from the power supply scanner 6 to the power feed line VL, two levels of the higher potential Vcc and the lower potential Vss2 are employed. At the start of the threshold voltage correction operation, the source S and drain of the drive transistor Trd are at the lower potential Vss2 and the higher potential Vcc, respectively, as shown in the timing chart. For the reason relating to the operation, the potential difference between the higher potential Vcc and the lower potential Vss2 reaches 15 V or higher.

On the other hand, enhancement in the display definition decreases the area per one pixel. Along with the area decrease, the capacitance of the holding capacitor Cs in one pixel becomes lower. If the capacitance of the holding capacitor Cs becomes lower, the mobility correction time becomes shorter in proportion to the capacitance decrease. Therefore, the margin for variation in the mobility correction time becomes smaller, which causes e.g. streaks along the scan lines on the screen.

As a countermeasure thereagainst, a method of decreasing the thickness of the dielectric film of the holding capacitor to thereby increase the capacitance thereof would be possible. In general, the holding capacitor and transistors included in the pixel circuit are simultaneously formed by using a thin film process. The dielectric film of the holding capacitor Cs and the gate insulating film of the transistors are formed of the same layer. When decreasing of the thickness of the dielectric film is attempted for increasing the capacitance of the holding capacitor Cs, the thickness of the gate insulating film of the drive transistor must also be decreased inevitably, which lowers the breakdown voltage of the drive transistor. In particular, the breakdown voltage between the source and drain of the drive transistor Trd is lowered to about 12 V. In the display shown in FIGS. 1 and 2, a complex correction operation is carried out by using two transistors in each pixel. Therefore, the supply voltage to the pixel is alternately switched between a higher potential and a lower potential, and at worst a voltage of 15 V or higher is applied between the source and drain of the drive transistor. Therefore, increasing the capacitance of the holding capacitor will cause a risk that voltage beyond the breakdown voltage between the source and drain of the drive transistor Trd is applied. Consequently, it is difficult to decrease the thickness of the gate insulating film of the drive transistor Trd and hence increase the capacitance of the holding capacitor Cs unless the configuration is improved.

Figure 4:
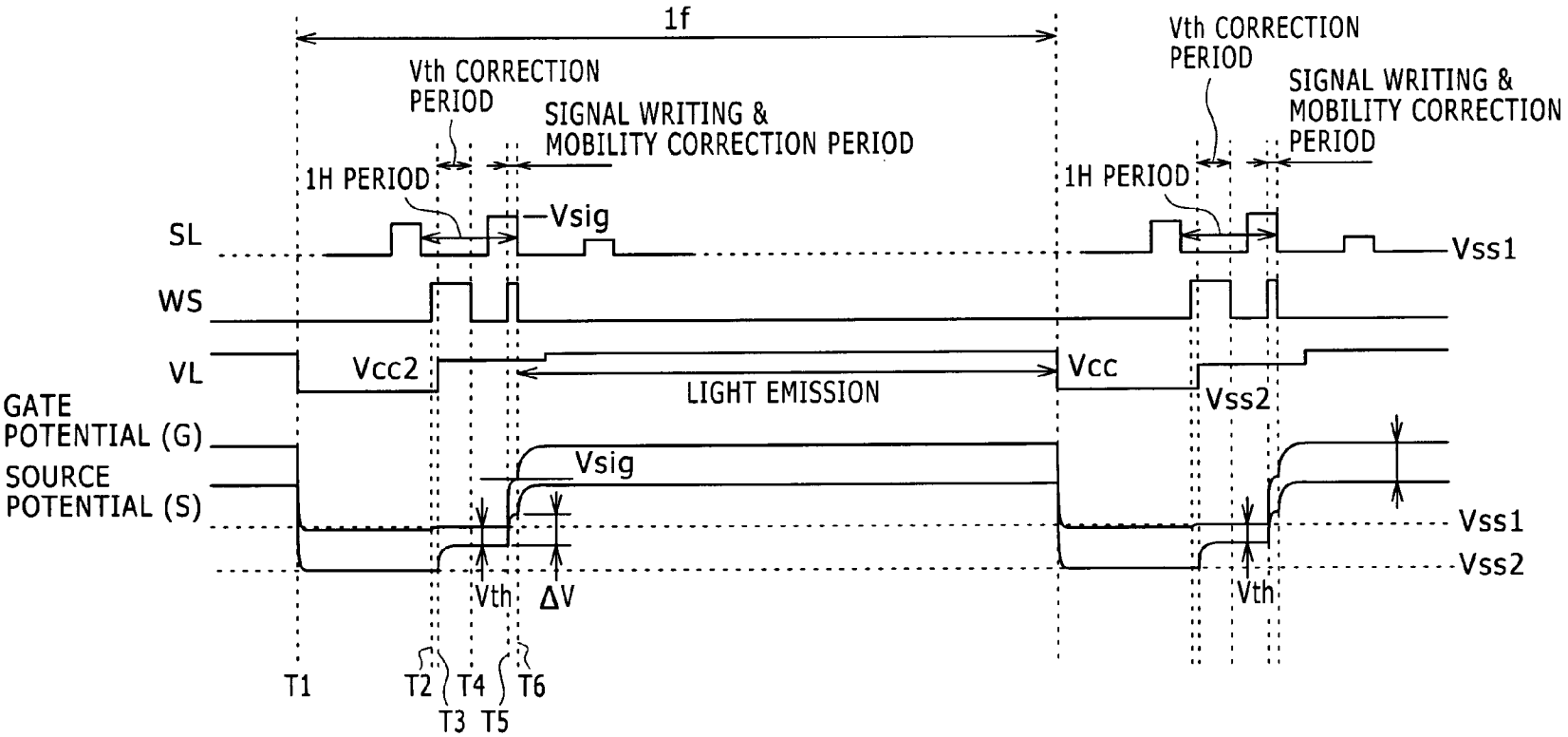
FIG. 4 is a timing chart for explaining the operation of the display shown in FIGS. 1 and 2 according to the embodiment.

FIG. 4 is a timing chart for explaining the operation of the display shown in FIGS. 1 and 2. This timing chart shows the operation of the embodiment of the present invention. For this chart, the same representation manner as that of the timing chart of the reference example shown in FIG. 3 is employed for easy understanding. As shown in this chart, in the present embodiment, the levels of the voltage applied to the power feed line VL are changed to three levels (Vcc, Vcc2, and Vss2) from two levels (Vcc and Vss2) in the reference example. The potential Vcc2 newly added in the embodiment is intermediate potential between the higher potential Vcc and the lower potential Vss2 used in the reference example. In the period during which the newly-added intermediate potential Vcc2 is applied to the power feed line VL, threshold voltage correction operation, signal potential writing operation, and mobility correction operation are carried out. Thereafter, the potential of the power feed line VL is raised to the higher potential Vcc after the sampling transistor Tr1 is turned off and thus a light-emission period starts. Due to this operation, the voltage applied between the source and drain of the drive transistor Trd is decreased to at most 12 V, which makes it possible to decrease the thickness of the gate insulating film.

As shown in the timing chart of FIG. 4, the operation sequence of each pixel enters a non-light-emission period at a timing T1, and then is switched to a light-emission period at a timing T6. In the former stage of this non-light-emission period T1-T6, the power feed line VL is at the lower potential Vss2. In the threshold voltage correction period T3-T4 and the signal potential writing period T5-T6 in the latter stage, the potential of the power feed line VL is raised to the intermediate potential Vcc2. Thereafter, in response to the start of the light-emission period, the potential of the power feed line VL is further raised to the higher potential Vcc. The potential of the power feed line VL is applied to the drain D of the drive transistor Trd.

The source potential of the drive transistor Trd is at the lowest level in the non-light-emission period T1-T3. In this period, the power feed line VL is also at the lower potential Vss2, and thus there is no fear that the voltage between the source and drain of the drive transistor surpasses the insulation breakdown voltage of the drive transistor. Subsequently, in the correction period T3-T6, the potential on the drain side is turned to the higher potential although the source potential slightly rises up. If in this period, the potential of the power feed line VL is not at the intermediate potential Vcc2 but at the higher potential Vcc like in the reference example, the voltage between the source and drain of the drive transistor possibly surpasses the breakdown voltage of the drive transistor. Therefore, in the present embodiment, the potential of the power feed line VL is set to the intermediate potential Vcc2. Thereafter, in the light-emission period, the potential of the power feed line VL is raised to the higher potential Vcc. However, at this time, the source potential of the drive transistor has also been greatly raised up due to a bootstrap operation. Consequently, there is no fear that the voltage between the drain and source of the drive transistor Trd surpasses the insulation breakdown voltage of the drive transistor Trd.

As is apparent from the above description, the periods involving the highest possibility that the voltage between the source and drain of the drive transistor Trd surpasses the insulation breakdown voltage are the threshold voltage correction period and the mobility correction period. Therefore, during the period when these correction operations are carried out, the potential of the power feed line VL is suppressed to the intermediate potential Vcc2, to thereby prevent excess voltage beyond the insulation breakdown voltage from being applied between the source and drain of the drive transistor. In other words, the insulation breakdown voltage of the drive transistor Trd can be decreased compared with the reference example, and correspondingly decreasing of the thickness of the gate insulating film and hence increasing of the capacitance of the holding capacitor can be achieved.

Figure 5:
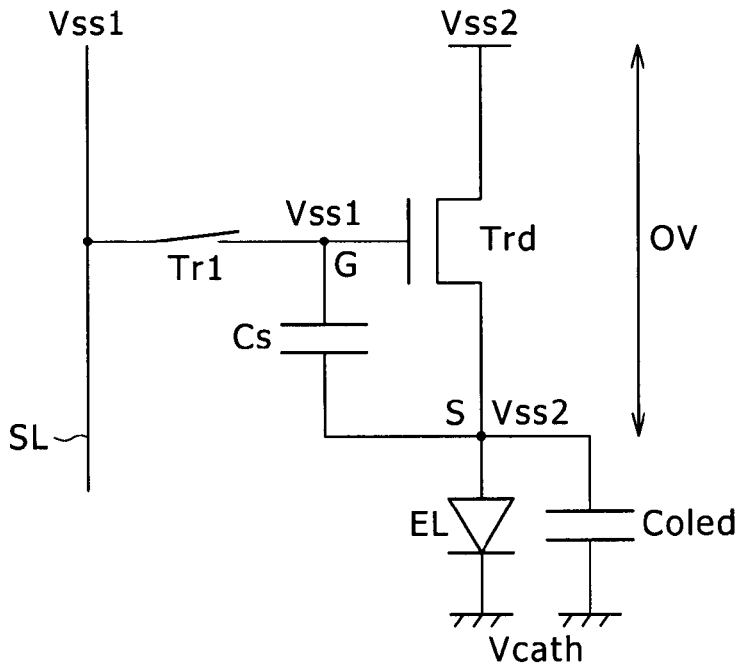
FIG. 5 is a circuit diagram for explaining the operation of the display shown in FIGS. 1 and 2.

With reference to FIGS. 5 to 8, details of the operation of the display according to the present embodiment will be described below. FIG. 5 shows the potential states in the pixel in the preparation period T2-T3. In this preparation period, the signal line SL is set at the reference potential Vss1 and the sampling transistor Tr1 is kept at the on-state. Thus, the reference potential Vss1 is written to the gate G of the drive transistor Trd. On the other hand, the power feed line is at the lower potential Vss2, which is lower than the value arising from subtraction of Vth from Vss1. Thus, the drive transistor Trd is in the on-state and therefore the source potential thereof is Vss2. In this way, the gate G and source S of the drive transistor Trd are initialized to Vss1 and Vss2, respectively, in the preparation period T2-T3. In this period, the drain and source of the drive transistor Trd are both at the potential Vss2, and hence the potential difference therebetween is 0 V.

Figure 6:
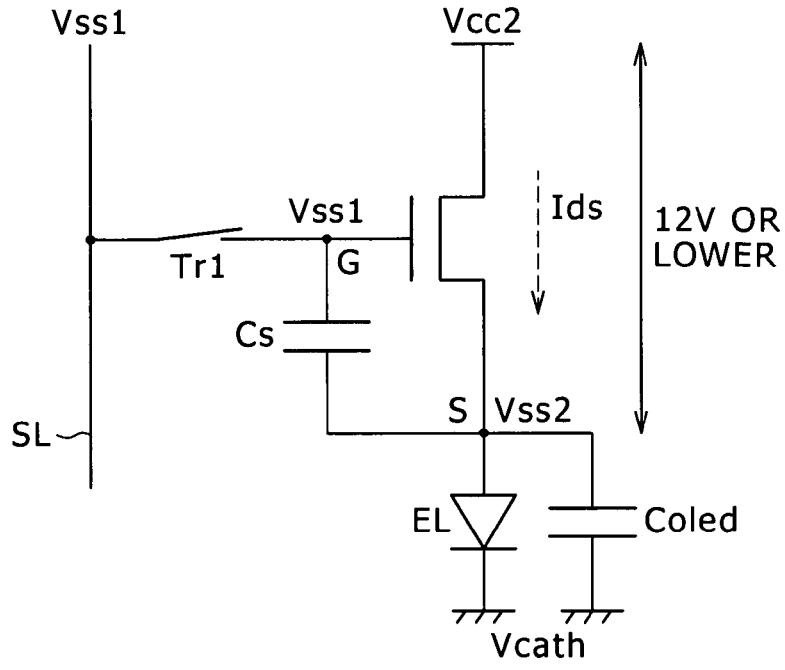
FIG. 6 is a circuit diagram for explaining the operation as with FIG. 5.

FIG. 6 shows the potential states in the pixel in the threshold voltage correction period T3-T4. Upon the start of this threshold voltage correction period, the supply voltage is raised to Vcc2 to thereby carry out threshold voltage correction operation. The drain current Ids in proportion to Vgs flows through the drive transistor Trd, so that the source potential rises up until the drive transistor Trd is cut off. In the reference example, the potential difference between the higher potential Vcc and the lower potential Vss2 is 15 V or higher. In contrast, in the present embodiment, the potential difference between Vcc2 and Vss2 is set to 12 V or lower. The potential Vss1, which is equal to the gate potential of the drive transistor Trd, is somewhat higher than Vss2+Vth as described above. Therefore, the drive transistor Trd operates in the saturation region with respect to Vcc2.

Figure 7:
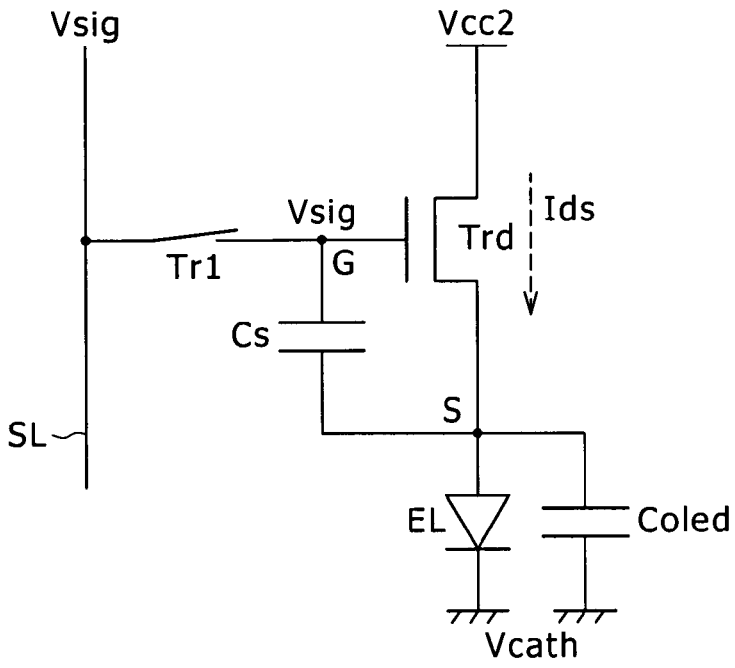
FIG. 7 is a circuit diagram for explaining the operation as with FIG. 6.

FIG. 7 shows the potential states in the pixel in the mobility correction period T5-T6. After the end of the above-described threshold voltage correction operation, the sampling transistor Tr1 is turned off temporarily. Subsequently, the potential of the signal line SL is switched to the signal potential Vsig, and then the sampling transistor Tr1 is turned on again. Due to this operation, the signal potential Vsig is written to the gate G of the drive transistor Trd, and mobility correction operation is carried out by negative feedback of the drain current Ids to the holding capacitor Cs. At this time, the supply voltage is still kept at the intermediate potential Vcc2. According to the general voltage design of the signal selector, the potential Vsig is set to about Vss1+5 V. According to the above description, the equation Vcc2=Vss2+12=Vss1−Vth+12≈Vss1+10 is obtained (based on the assumption that Vth is 2 V). Therefore, the relationship Vcc2>Vsig is obtained, and thus the drive transistor Trd always operates in the saturation region during the mobility correction operation. For accurate mobility correction operation, the drive transistor Trd needs to operate in the saturation region. In the present embodiment, accurate operation is ensured.

Figure 8:
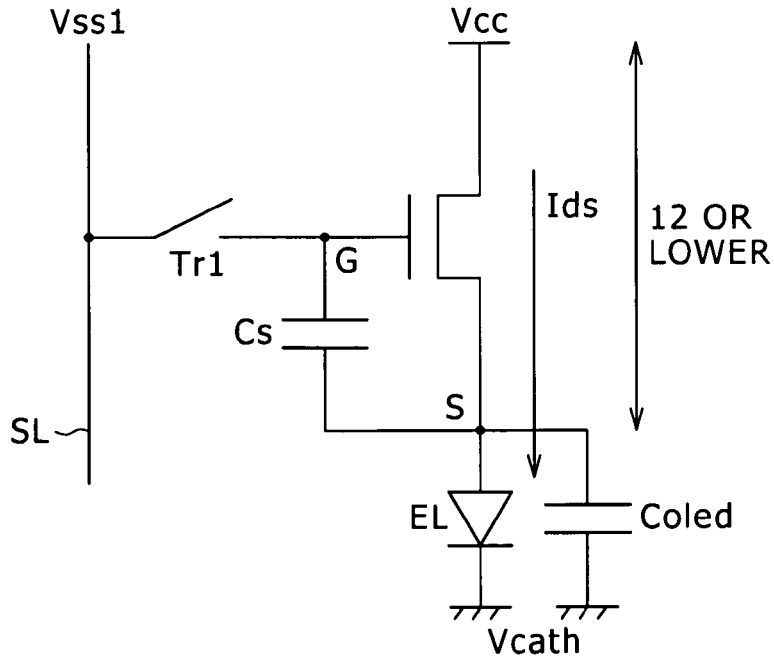
FIG. 8 is a circuit diagram for explaining the operation as with FIG. 7.

FIG. 8 shows the potential states in the pixel in the light-emission period. After the mobility correction operation is ended by turning off the sampling transistor Tr1, the supply voltage to the pixel is raised to Vcc. When the sampling transistor Tr1 is turned off, the impedance of the gate G of the drive transistor Trd is increased. Therefore, the anode potential of the light-emitting device EL (i.e., the source potential of the drive transistor Trd) rises up depending on the drain current Ids and the potential of the gate G also rises up in linkage with the rise-up of the anode potential based on bootstrap operation. At this time, in the case of white displaying, the source potential rises up by 5 V or higher. Therefore, if the supply voltage is still kept at the intermediate potential Vcc2, the relationship Vg (gate potential)>Vcc2+Vth will arise, which possibly causes a fear that the drive transistor Trd is linearly driven. The linear driving will lower the uniformity of the image quality. To avoid this problem, in the present embodiment, the supply voltage Vcc is so set as to satisfy the relationship Vg<Vcc+Vth during the light-emission period. This voltage setting allows the drive transistor Trd to operate in the saturation region during the light-emission period, which can achieve high uniformity. It should be noted that this higher potential Vcc is so designed that the voltage between the source and drain of the drive transistor Trd is at most 12 V.

Due to the above-described feature, in the present embodiment, the voltage between the source and drain of the drive transistor Trd can be suppressed to at most 12 V, which is the breakdown voltage. Therefore, a process with a gate insulating film having decreased thickness can be applied, which can further enhance the display definition.

Figure 9:
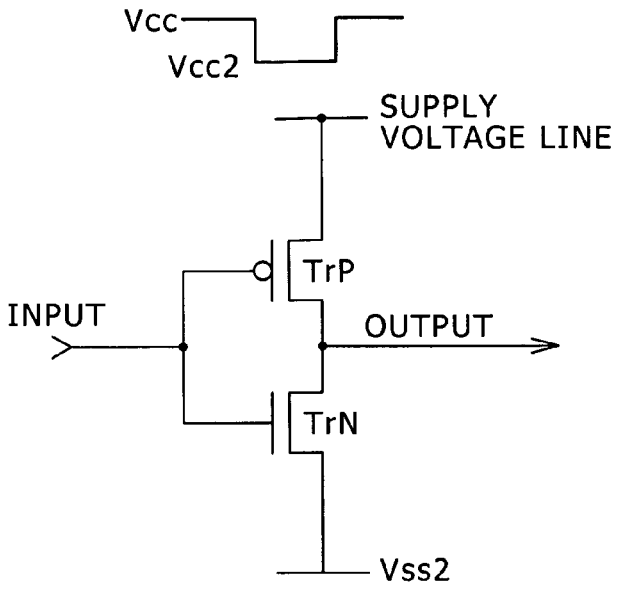
FIG. 9 is a partial diagram showing the configuration of a power supply scanner included in the display shown in FIGS. 1 and 2.

FIG. 9 is a partial circuit diagram showing the configuration of the power supply scanner included in the display shown in FIGS. 1 and 2. The power supply scanner includes a shift register and output buffers connected to the respective stages of the shift register. The shift register sequentially outputs a pulse on a stage-by-stage basis in synchronization with the line-sequential scanning. The output buffers are each provided for a respective one of the stages of the shift register. FIG. 9 shows the output buffer for one stage. This output buffer is formed of an inverter disposed between a supply voltage line and a GND voltage line. This inverter is composed of a pair of a P-channel transistor TrP and an N-channel transistor TrN. The input side of the inverter corresponds to a stage of the shift register, and the output side thereof is connected to the corresponding power feed line.

To the supply voltage line, a supply pulse whose level is switched between two levels of Vcc and Vcc2 is supplied from an external pulse power supply. The potential of the GND ground line is fixed at Vss2. When the input signal to the inverter is at the low level, the P-channel transistor TrP is turned on, so that the potential Vcc or Vcc2 supplied to the supply voltage line is output. On the other hand, when the input signal is at the high level, the N-channel transistor TrN is turned on and thus the lower potential Vss2 is supplied to the power feed line on the output side. In this way, corresponding to the timings of the switching between the low level and high level of the input signal, the first higher potential Vcc, the second higher potential Vcc2, or the lower potential Vss2 is supplied to the output side in a predetermined sequence.

Figure 10:
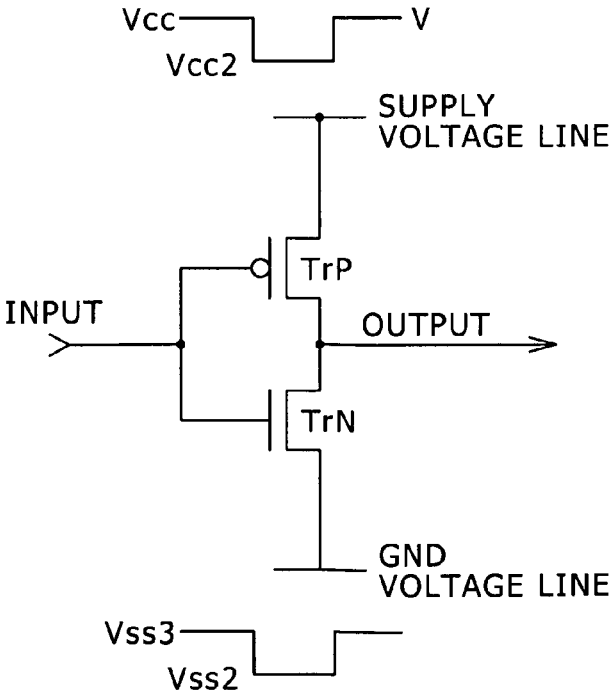
FIG. 10 is a partial diagram showing another example of the power supply scanner.

FIG. 10 shows a modification example of the output buffer shown in FIG. 9. The same part is given the same symbol for easy understanding. The modification example is different in that a first lower potential Vss3 and a second lower potential Vss2 lower than the potential Vss3 are supplied from the external pulse power supply to the GND voltage line (ground line) connected to the inverter of the output buffer, in such a manner as to be alternately switched to each other. By thus switching the lower potential on the GND voltage line side between Vss3 and Vss2 simultaneously with the switching of the higher potential on the supply voltage line side between Vcc and Vcc2, the voltage applied between the source and drain of the transistors TrP and TrN of the output buffer is prevented from surpassing the insulation breakdown voltage. Due to this feature, the transistors in the pixel array section and the transistors in the power supply scanner included in the peripheral drive section can be integrally formed in the same thin film process.

Figure 11:
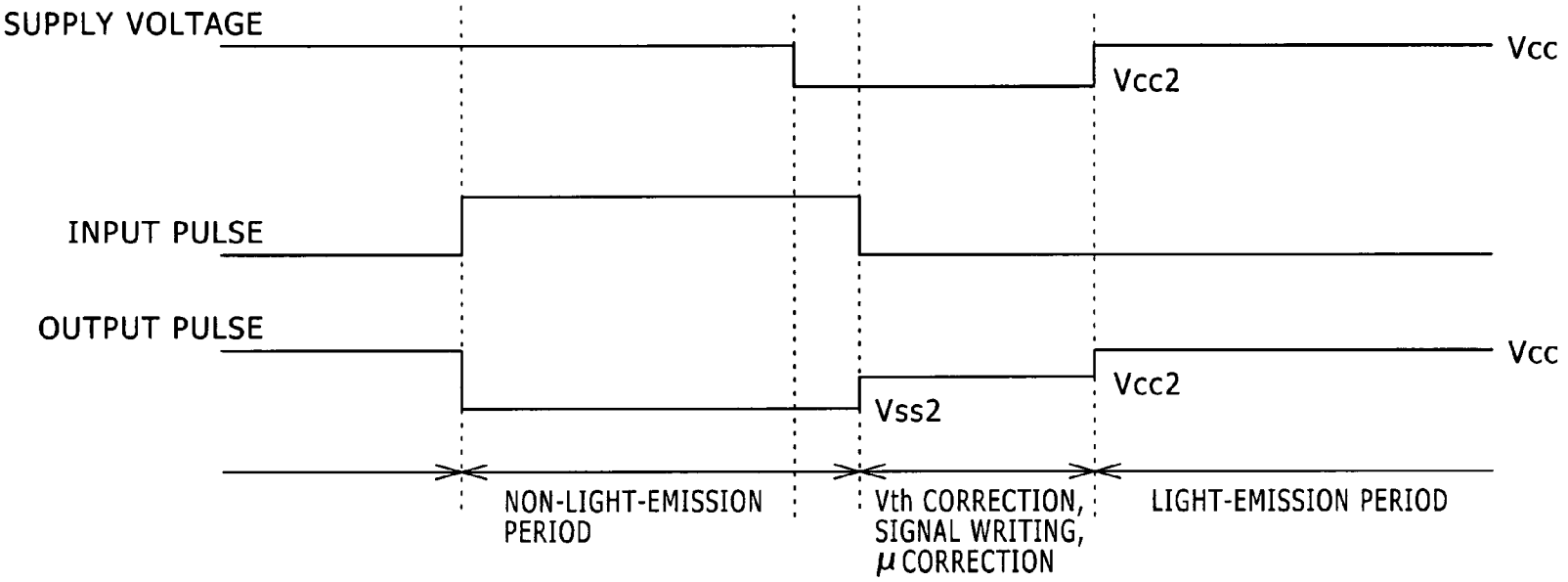
FIG. 11 is a timing chart for explaining the operation of the power supply scanner shown in FIG. 9.

FIG. 11 is a timing chart for explaining the operation of the output buffer shown in FIG. 9. As described above, the supply voltage is switched between Vcc2 and Vcc in a predetermined sequence. The inverter of the output buffer operates in accordance with the input pulse so as to properly select Vcc or Vcc2 on the supply voltage side or Vss2 on the ground line side and supply the selected potential as the output pulse to the corresponding power feed line. As shown in the chart, the phases of the supply voltage pulse and the input pulse are adjusted based on a predetermined relationship therebetween. As a result, the output pulse is sequentially switched to the lower potential Vss2 during a non-light-emission period, to the intermediate potential Vcc2 during threshold voltage correction period and signal writing period, and to the higher potential Vcc during a light-emission period.

Figure 12:
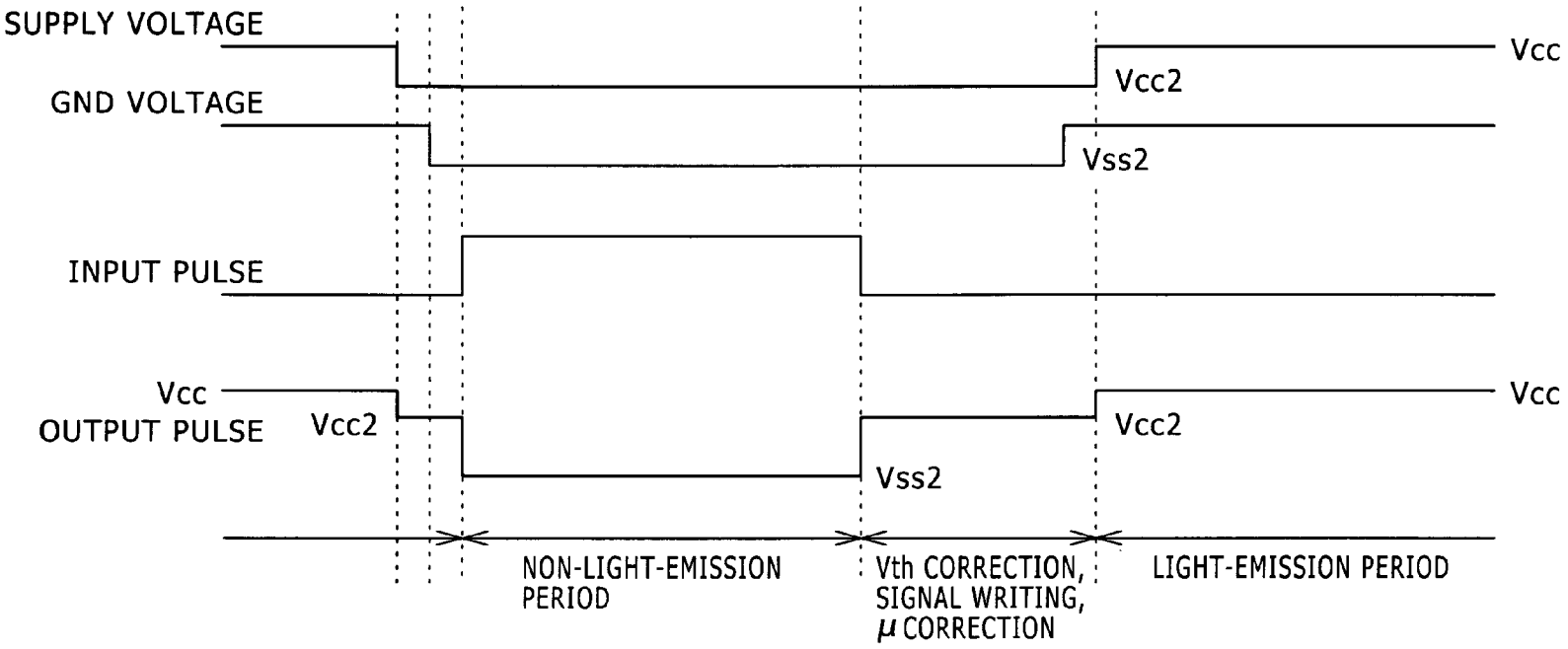
FIG. 12 is a timing chart for explaining the operation of the power supply scanner shown in FIG. 10.

FIG. 12 is a timing chart for explaining the operation of the output buffer shown in FIG. 10. For the timing chart of FIG. 12, the same representation manner as that of the timing chart of FIG. 11 is employed for easy understanding. As described above, the supply voltage is switched between Vcc2 and Vcc. Corresponding to this switching, the GND voltage (ground voltage) is switched between Vss2 and Vss3. Specifically, after the potential on the power supply line side is switched from the first higher potential Vcc2 to the second higher potential Vcc2, the potential on the ground line side is switched from the first lower potential Vss3 to the second lower potential Vss2. Subsequently, after the potential on the ground line side is returned to the first lower potential Vss3 from the second lower potential Vss2, the potential on the power supply line side is returned to the first higher potential Vcc from the second higher potential Vcc2. This potential design prevents excess voltage from being applied between the source and drain of the P-channel transistor and N-channel transistor of the inverter.

Figure 13:
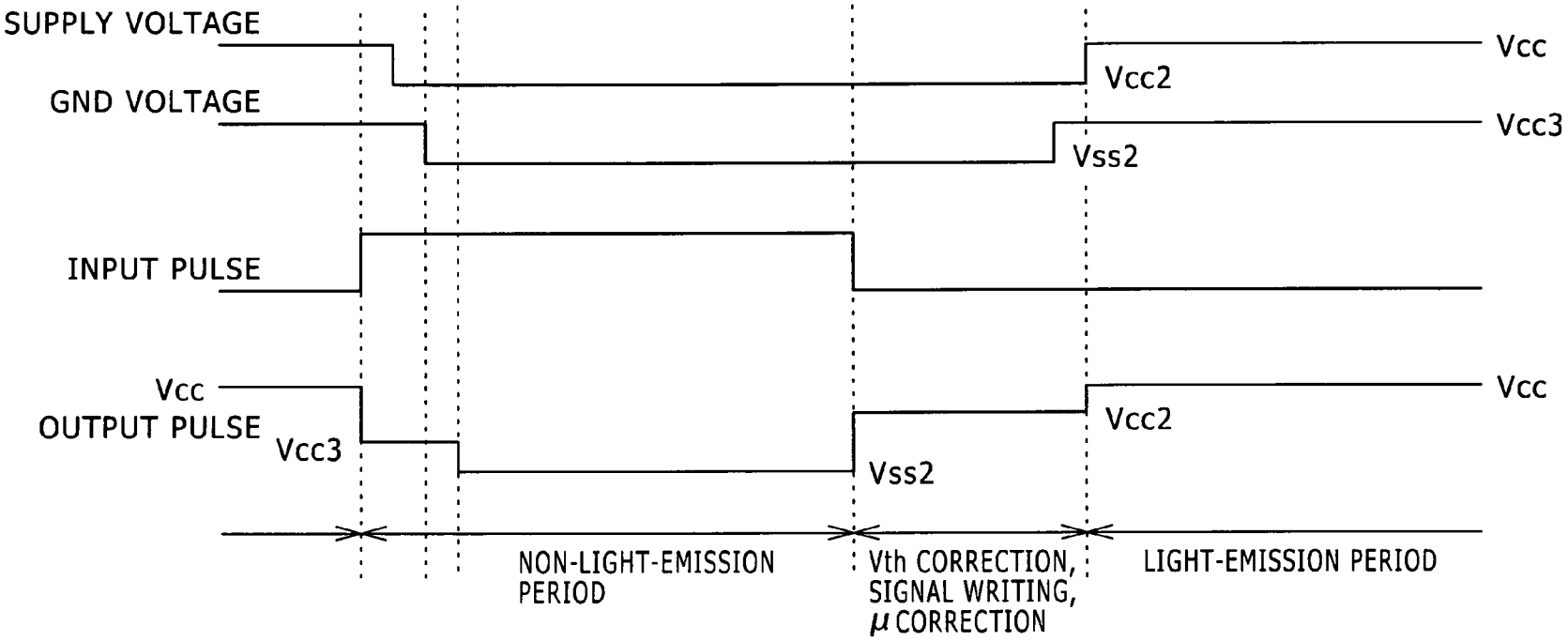
FIG. 13 is another timing chart for explaining the operation of the power supply scanner shown in FIG. 10.

FIG. 13 is a timing chart for explaining the operation of the output buffer shown in FIG. 10. Also for the timing chart of FIG. 13, the same representation manner as that of the timing chart of FIG. 12 is employed for easy understanding. The chart of FIG. 13 is different from the chart of FIG. 12 in that the rise-up timing of the input pulse is shifted forward compared with the example of FIG. 12. This design can also prevent excess voltage from being applied between the source and drain of the P-channel transistor and N-channel transistor of the inverter.

Figure 14:
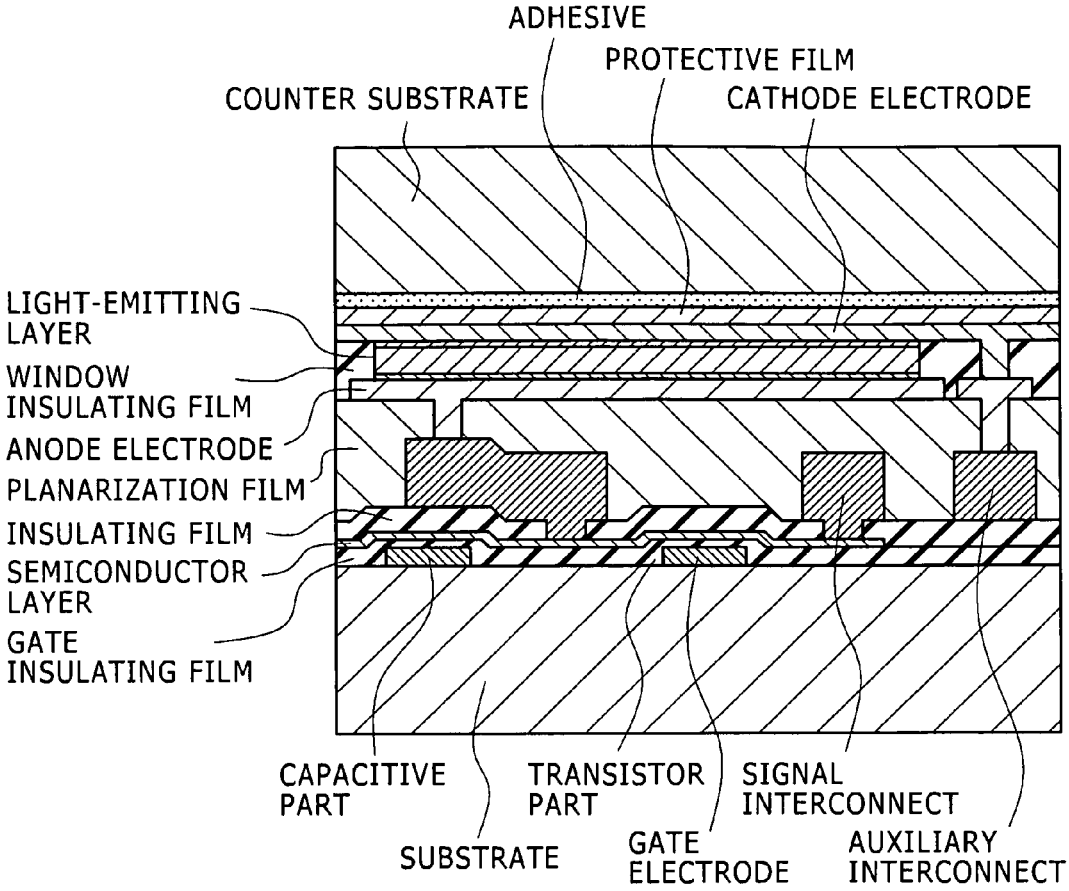
FIG. 14 is a sectional view showing the device structure of the display according to the embodiment.

The display according to the present embodiment has a thin film device structure like that shown in FIG. 14. FIG. 14 shows a schematic sectional structure of a pixel formed on an insulating substrate. As shown in FIG. 14, the pixel includes a transistor section having plural thin film transistors (one TFT is shown in FIG. 14), a capacitive section such as a holding capacitor, and a light-emitting section such as an organic EL element. The transistor section and the capacitive section are formed on the substrate by a TFT process, and the light-emitting section such as an organic EL element is stacked thereon. A counter substrate is attached over the light-emitting section with the intermediary of an adhesive, so that a flat panel is obtained.

Figure 15:
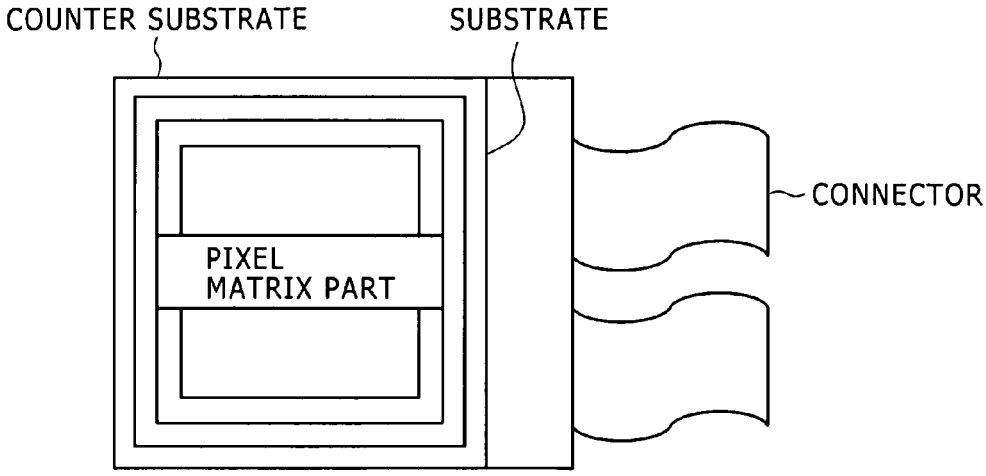
FIG. 15 is a plan view showing the module structure of the display according to the embodiment.

The display according to the present embodiment encompasses a display having a flat module shape like that shown in FIG. 15. For example, the display module is obtained as follows. A pixel array section in which pixels each including an organic EL element, thin film transistors, a thin film capacitor, and so on are integrally formed into a matrix is provided on an insulating substrate. Subsequently, an adhesive is disposed to surround this pixel array section (pixel matrix section), and a counter substrate composed of glass or the like is bonded to the substrate. This transparent counter substrate may be provided with e.g. a color filter, protective film, and light-shielding film according to need. The display module may be provided with e.g. a flexible printed circuit (FPC) as a connector for inputting/outputting of signals and so forth to/from the pixel array section from/to the external.

The display according to the above-described embodiment has a flat panel shape, and can be applied to a display in various kinds of electronic apparatus in any field that displays image or video based on a drive signal input thereto or produced therein, such as a digital camera, notebook personal computer, cellular phone, and video camera. Examples of electronic apparatus to which such a display is applied will be described below.

Figure 16:
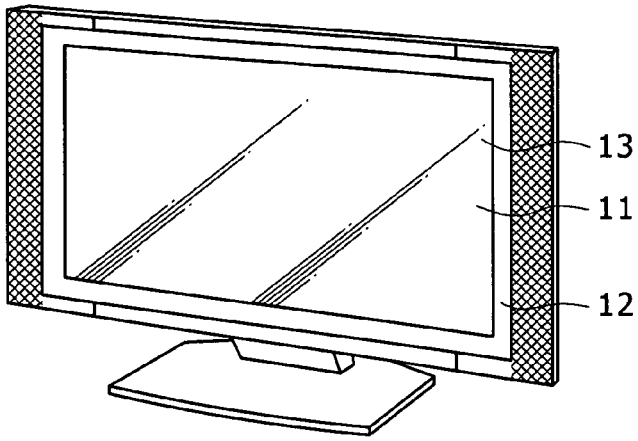
FIG. 16 is a perspective view showing a television set including the display according to the embodiment.

FIG. 16 shows a television to which the embodiment is applied. The television includes a video display screen 11 composed of a front panel 12, a filter glass 13, and so on, and is fabricated by using the display according to the embodiment as the video display screen 11.

Figure 17:
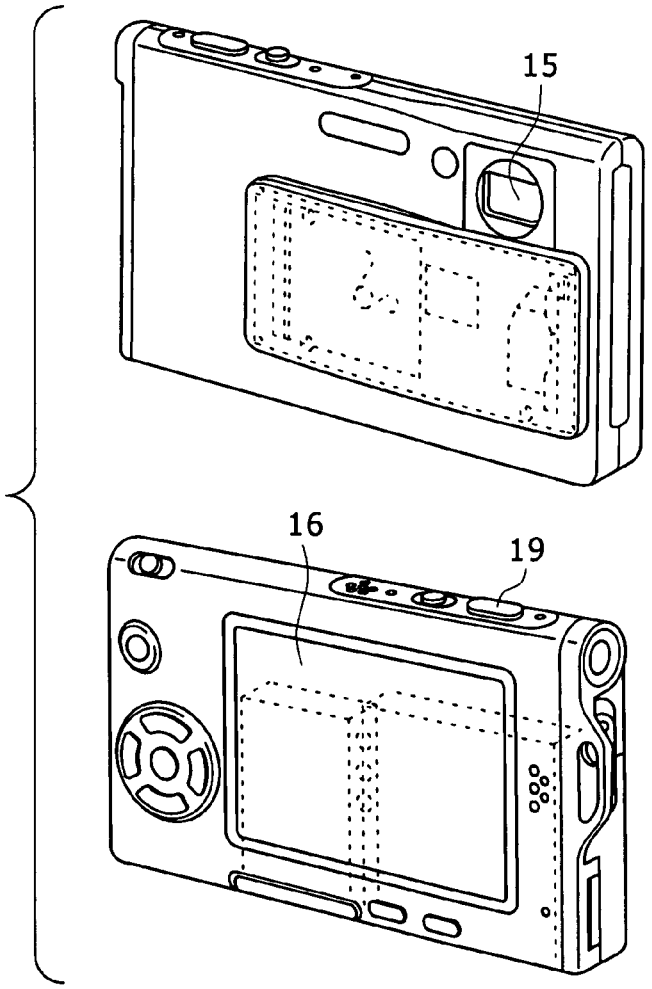
FIG. 17 is a perspective view showing a digital still camera including the display according to the embodiment.

FIG. 17 shows a digital camera to which the embodiment is applied: the upper diagram is a front view and the lower diagram is a rear view. This digital camera includes an imaging lens, a light emitter 15 for flash, a display section 16, a control switch, a menu switch, a shutter button 19, and so on, and is fabricated by using the display according to the embodiment as the display section 16.

Figure 18:
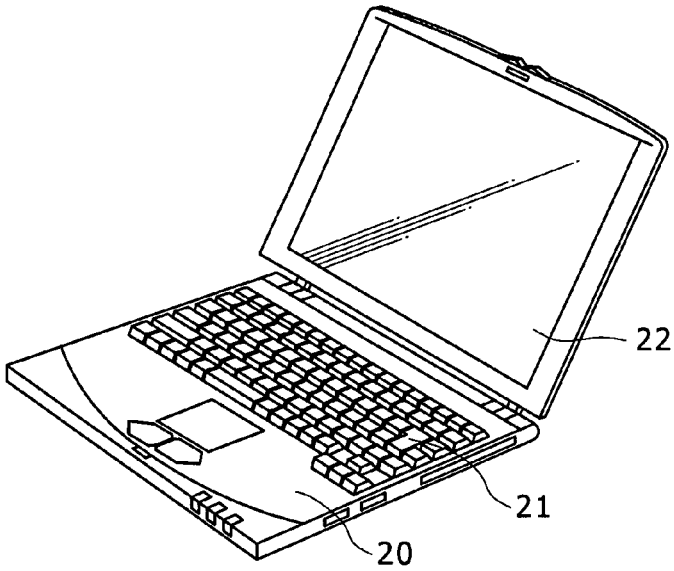
FIG. 18 is a perspective view showing a notebook personal computer including the display according to the embodiment.

FIG. 18 shows a notebook personal computer to which the embodiment is applied. A main body 20 of the personal computer includes a keyboard 21 that is operated in inputting of characters and so on, and the body cover thereof includes a display section 22 that displays images. The personal computer is fabricated by using the display according to the embodiment as the display section 22.

Figure 19:
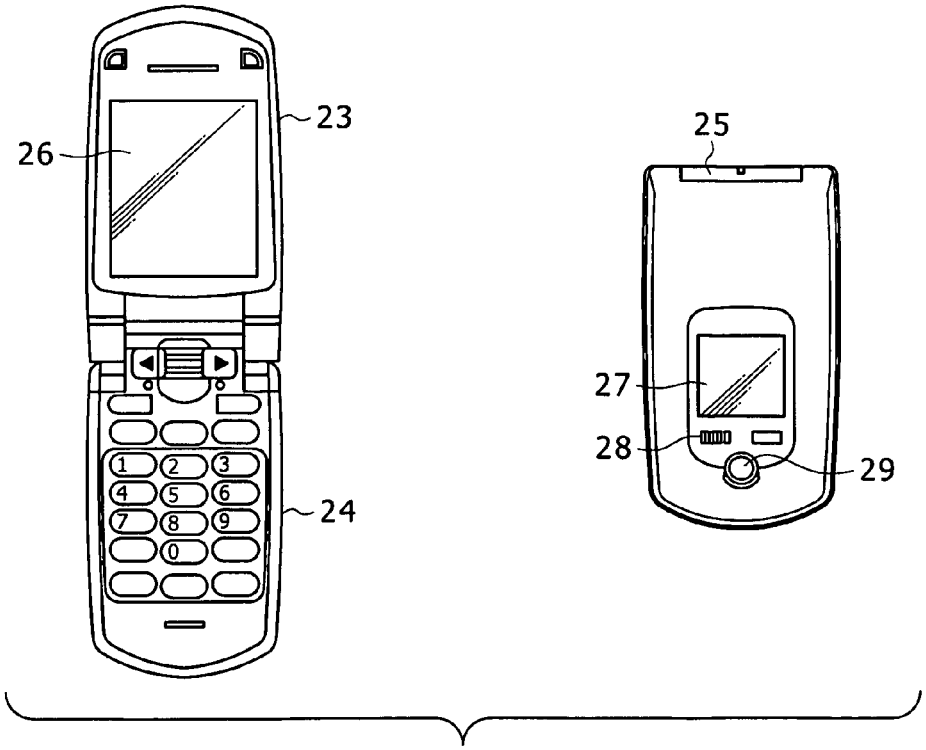
FIG. 19 is a schematic diagram showing a portable terminal device including the display according to the embodiment.

FIG. 19 shows a portable terminal device to which the embodiment is applied: the left diagram shows the opened state and the right diagram shows the closed state. This portable terminal device includes an upper casing 23, a lower casing 24, a connection (hinge) 25, a display 26, a sub-display 27, a picture light 28, a camera 29, and so on. The portable terminal device is fabricated by using the display according to the embodiment as the display 26 and the sub-display 27.

Figure 20:
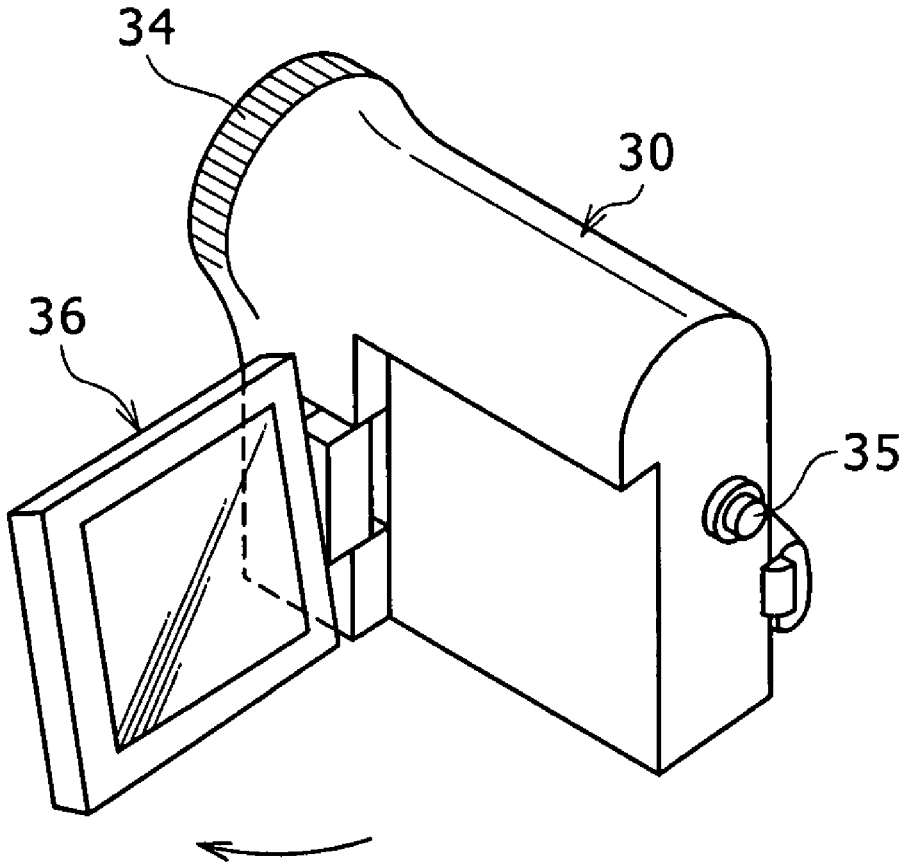
FIG. 20 is a perspective view showing a video camera including the display according to the embodiment.

FIG. 20 shows a video camera to which the embodiment is applied. The video camera includes a main body 30, a lens 34 that is disposed on the front side of the camera and used to capture a subject image, a start/stop switch 35 for imaging operation, a monitor 36, and so on. The video camera is fabricated by using the display according to the embodiment as the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display, comprising:

a pixel array section configured to include power feed lines, scan lines disposed along rows, signal lines disposed along columns, and pixels that are disposed at intersections of the scan lines and the signal lines and are arranged in a matrix, each of the pixels including a drive transistor and a light-emitting device, one of a pair of current terminals as source and drain of the drive transistor being connected to the power feed line; and a power supply scanner configured to sequentially switch potential of each power feed line between a first higher potential, a second higher potential, and a lower potential, wherein the power supply scanner switches the power feed line between first higher potential and second higher potential at different levels in a predetermined sequence, the power supply scanner includes a shift register and output buffers that are each connected to a respective one of stages of the shift register, the shift register sequentially produces a switch signal for each of the stages, the output buffer is provided between a power supply line and a ground line, and the output buffer switches potential between the first or second higher potential on a power supply line side and the lower potential on a ground line side in accordance with the switch signal and applies the potential to a corresponding one of the power feed lines, the first higher potential and the second higher potential are supplied to the power supply line side of the output buffer in such a manner as to be alternately switched to each other, and a first lower potential and a second lower potential lower than the first lower potential are supplied to the ground line side of the output buffer in such a manner as to be alternately switched to each other in linkage with the switching between the first higher potential and the second higher potential, and the switching between the first lower potential and the second lower potential is so carried out that voltage applied between source and drain of a transistor included in the output buffer provided between the power supply line and the ground line is prevented from surpassing insulation breakdown voltage.

2. The display according to claim 1, wherein the output buffer switches potential on the ground line side from the first lower potential to the second lower potential after switching potential on the power supply line side from the first higher potential to the second higher potential, and returns the potential on the power supply line side to the first higher potential from the second higher potential after returning the potential on the ground line side to the first lower potential from the second lower potential.

3. The display according to claim 2, wherein the power supply scanner prevents voltage applied between the source and drain of the drive transistor from surpassing insulation breakdown voltage in a series of operation of the pixel by switching the higher potential applied to the power feed line between the first higher potential and the second higher potential at the different levels in the predetermined sequence.

4. An electronic apparatus comprising the display of claim 1.

* * * * *